US007468484B1

(12) United States Patent
Yatsenko

(10) Patent No.: US 7,468,484 B1
(45) Date of Patent: Dec. 23, 2008

(54) FAST-MOVING CUMULATIVE TORPEDO-MINE "PRESENT"

(76) Inventor: Yuriy Yatsenko, 7639 Loretto Ave., Philadelphia, PA (US) 19111

( * ) Notice: Subject to any disclaimer, the term of this patent is extended or adjusted under 35 U.S.C. 154(b) by 147 days.

(21) Appl. No.: 11/638,908

(22) Filed: Dec. 14, 2006

(51) Int. Cl.
*F42B 19/00* (2006.01)

(52) U.S. Cl. ..... 114/20.1

(58) Field of Classification Search ..... 114/20.1–25; 102/307, 476
See application file for complete search history.

(56) References Cited

U.S. PATENT DOCUMENTS 3,779,194 A * 12/1973 Kahn ..... 114/20.1
4,188,884 A * 2/1980 White et al. ..... 102/399
5,078,069 A * 1/1992 August et al. ..... 114/20.1

* cited by examiner

*Primary Examiner*—Troy Chambers
(74) *Attorney, Agent, or Firm*—Aleksandr Smushkovich

(57) ABSTRACT

An embodiment of torpedo, providing increased explosive energy, comprises: a casing encapsulating a rubber container, having frontal cumulative cavities with peripheral magnetic rings, said container containing an elongated type explosive charge, an axle, a bushing slidely mounted on the axle, spokes associated with the bushing and container's front, cumulative cups with press-detonators; a formatter, joined with the container's rear portion, slidely disposed on the axle, capable to displace the charge from the rear to the middle of container thereby converting it into a cumulative type charge; a magnetic cup slidely disposed on the axle; an engine unit including a cylindrical shell, fixed to the casing, the shell containing aluminum thin double-wall pipes furnished with ignition detonators. The pipes are innerly stuffed with compressed pyroxylin gunpowder; the internal space between the pipes' double-walls is filled with water, gasified during the torpedo's launch and outlet from the rear, increasing the torpedo's speed.

6 Claims, 3 Drawing Sheets

FAST-MOVING CUMULATIVE TORPEDO-MINE "PRESENT"

TECHNICAL FIELD

The present invention relates to explosive devices, particularly to torpedo and mine devices.

BACKGROUND OF THE INVENTION

There are several types of firing military load or ammunition known in pyrotechnics, such as concentrated explosive charges, elongated explosive charges, and cumulative explosive charges. The concentrated charges are customarily used in fougasse bombs, land mines, and different kinds of grenades. The elongated charges are often utilized to stuff rockets and torpedos, for clearing of minefields, etc.; they mainly act on the target by the front portion of the charge, whereas the explosive energy of the remaining portion of the charge is spread toward other directions. The cumulative charges are usually supplied for stuffing special purpose grenades and mines, e.g. naval mines for destroying armored enemy ships and submarines. A body of a cumulative explosive charge is performed with at least one cumulative cavity (concave hole) on its surface, serving to concentrate the energy of explosion in the direction towards the object to be destroyed.

Apparently, the cumulative type of charge is substantially more effective than the elongated type of charge. However, torpedos are commonly furnished with the elongated type charges due to their usually cigar-like shape (dictated by hydrodynamics to allow for high speed of the torpedo) that causes their low explosive efficiency.

BRIEF SUMMARY OF THE INVENTION

It is therefore an aim of the present invention to provide a novel and useful device, capable to combine the mobility of torpedo with the effectiveness of a cumulative explosive charge. Another aim of the invention is to increase the velocity of the torpedo movement. Other aims of the invention might become apparent to a skilled artisan from a consideration of the drawings, ensuing description, and claims as hereinafter related.

An embodiment of the inventive device comprises an elongated casing preferably made of plastic, and preferably having a cigar-like shape. The casing encapsulates a rubber container having a front portion, a middle portion, and a rear portion stuffed with an explosive charge of granulated trotyl (TNT). The surface of the rubber container has a predetermined number of cumulative cavities on the front portion. Each cumulative cavity on its periphery has a magnetic ring. Each cumulative cavity is attached to the front portion of the rubber container with its opening facing outside the container.

The inventive embodiment comprises a bearing tubular axle, preferably made of suitable metal, extending inside the rubber container along the longitudinal axis of the device; a central bushing slidely mounted on the axle and initially situated in the middle portion of the rubber container; preferably four bendable springed spokes disposed in the rubber container, associated with the bushing and with the front portion of the rubber container.

The embodiment comprises a central cavity, preferably made of steel with magnetic properties, is positioned at the center of the front portion of the rubber container and slidely disposed on the front portion of the axle. The inventive embodiment comprises a predetermined number (here is four) of intermediate cumulative cups fixedly mounted inside the rubber container on the axle, each intermediate cup is preferably filled with solid hexogen, and furnished with a press-detonator.

The embodiment of the device comprises a rear formatter, joined with the rear portion of the rubber container, which formatter is preferably shaped as a cup opened toward the rubber container, the formatter is slidely disposed on the axle and capable to displace the explosive charge from the rear portion of the rubber container to the middle and front portions thereof.

The embodiment comprises an engine unit including a preferably cylindrical duralumin shell, by its front part fixedly connected to the rear end of the casing, and with its rear part having a keel, a wireless control unit, and an antenna mounted thereon. The engine shell contains a predetermined number of preferably aluminum thin double-wall pipes disposed parallel to the longitudinal axis of device. The inner space of each pipe is stuffed with compressed artillery pyroxylin gunpowder; the internal space between the double-walls of each pipe is filled with water. Each pipe on its rear end is furnished with a primary gunpowder ignition detonator each having an electrical fuse.

BRIEF DESCRIPTION OF THE DRAWINGS

Identical reference numerals are in general referred to the same or similar units or parts on different drawings.

DESCRIPTION OF THE PREFERRED EMBODIMENT OF THE PRESENT INVENTION

Figure 1:
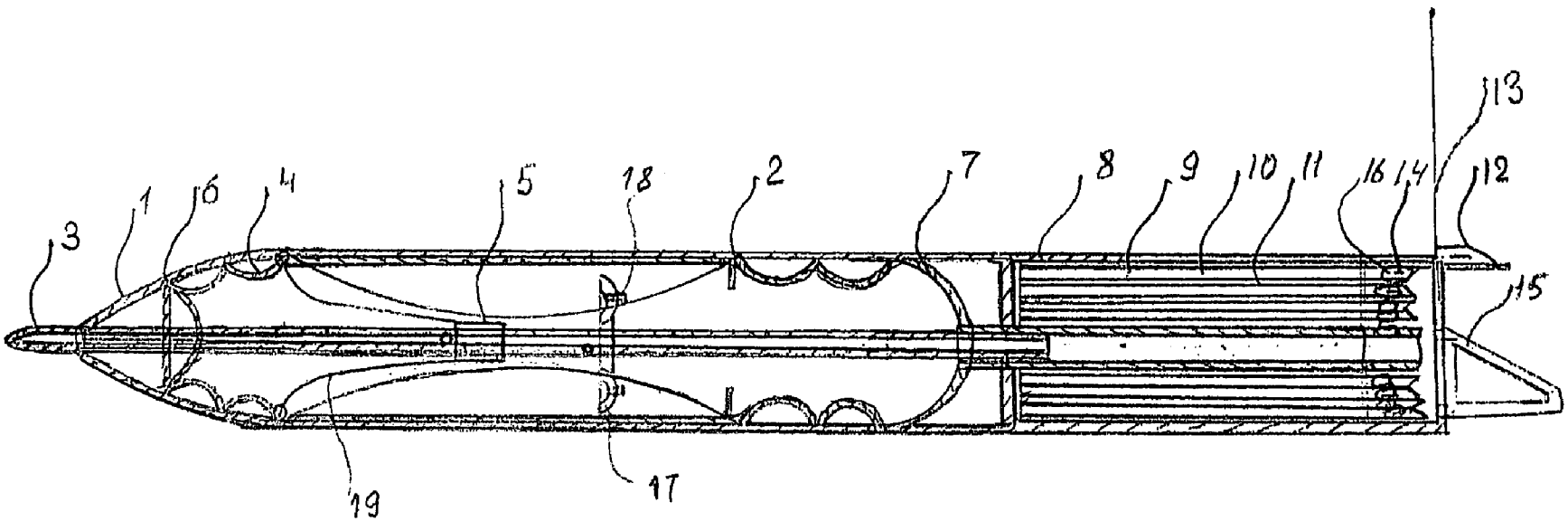
FIG. 1 illustrates a sectional side view of the inventive device in its initial position, according to a preferred embodiment of the present invention.

While the invention may be susceptible to embodiment in different forms, there is shown in the drawings, and will be described in detail herein, a specific embodiment of the present invention, with the understanding that the present disclosure is to be considered an exemplification of the principles of the invention, and is not intended to limit the invention to that as illustrated and described herein.

Referring to the drawing on FIG. 1, there is shown an embodiment of the inventive torpedo device comprising an elongated casing (1) preferably made of plastic, and preferably having a cigar-like shape. The casing 1 encapsulates a rubber container (2), having a front portion, a middle portion, and a rear portion. The rubber container 2 has a substantially cylindrical shape generally wider than the casing 1, and is folded so that accommodated into the casing 1, and then is stuffed with an explosive charge of granulated trotyl (TNT). The surface of the rubber container 2 has a predetermined number (preferably eight in this embodiment) of cumulative cavities (4) on the front portion thereof. Each cumulative cavity 4 on its periphery has a magnetic ring (21). Each cumulative cavity 4 is attached to the front portion of the rubber container 2 with its opening facing outside the container.

The inventive embodiment, shown on FIG. 1, comprises a bearing tubular axle (3), preferably made of suitable metal extending inside the rubber container 2 along the longitudinal axis of the device, the axle 3 including a front end, a middle region, and a rear end; a central bushing (5) slidely mounted on the axle 3 and initially situated in the middle portion of the rubber container 2, the bushing 5 having a latch mechanism (not shown); a plurality, preferably four, of bendable springed spokes (19) initially bent at a predetermined angle relatively to the longitudinal axis of the device. The spokes 19 are disposed in the rubber container 2, attached with their first ends to the front of the bushing 5, and with their second ends to the front portion of the rubber container 2, so that the container 2 with the spokes 19 are accommodated within the casing 1. The spokes 19 are initially fixed by the latch mechanism of the bushing 5.

The embodiment comprises a central front magnetic cup (6) preferably made of steel with ferromagnetic properties, positioned at the center of the front portion of the rubber container 2, facing outside the container, and slidely disposed on the front portion of the axle 3.

The embodiment comprises a predetermined number of intermediate cumulative cups (17) mounted inside the rubber container 2, and capable to slide along the axle 3. Each intermediate cup 17 is preferably filled with solid hexogen and furnished with a press-detonator (18) triggered by applying outer pressure to predetermined spots on its surface.

The embodiment of the torpedo, illustrated on FIG. 1, comprises a rear formatter (7), joined with the rear portion to the rubber container 2. The formatter 7 is preferably shaped as a cup opened forward toward the rubber container 1. The formatter 7 is slidely disposed on the axle 3. In its initial position the formatter 7 is situated at the rear end of the axle 3. The formatter 7 is capable to displace part of the trotyl charge, initially disposed in the rear portion of the container 2, to the middle and front portions thereon. During operation, as described below, in its very frontal position, the formatter 7 is capable to meet the cups 17, and apply outer pressure to the predetermined spots on their surface thereby triggering the press-detonators 18.

The embodiment, depicted on FIG. 1, comprises an engine unit including a preferably cylindrical duralumin shell (8), by its front part fixedly connected to the rear portion of the casing 1. A rear part of the shell 8 has a keel (15), a wireless control unit (12), and an antenna (13), mounted thereon. The engine shell 8 contains a predetermined number of preferably aluminum thin double-wall pipes (9), disposed parallel to the longitudinal axis of device; the inner space of each pipe 9 is stuffed with a load of compressed artillery pyroxylin gunpowder (10) used as fuel. Other embodiments can utilize other suitable types of fuel. The shell 8 contains a central cylindrical through hole capable to accommodate the axle 3 at its very rear position, so that the rear end of the axle 3 is outstanding the shell 8, as shown on FIG. 2.

This embodiment defines an internal space (11) between the double walls of the pipes 9, filled with a body of water. The rear end of the internal space 11 of each pipe 9 is initially closed, and capable to open after the torpedo is fired. In this embodiment, each pipe 9 on its rear end is furnished with a primary gunpowder detonator (16), each having an electrical ignition fuse (14).

Figure 2:
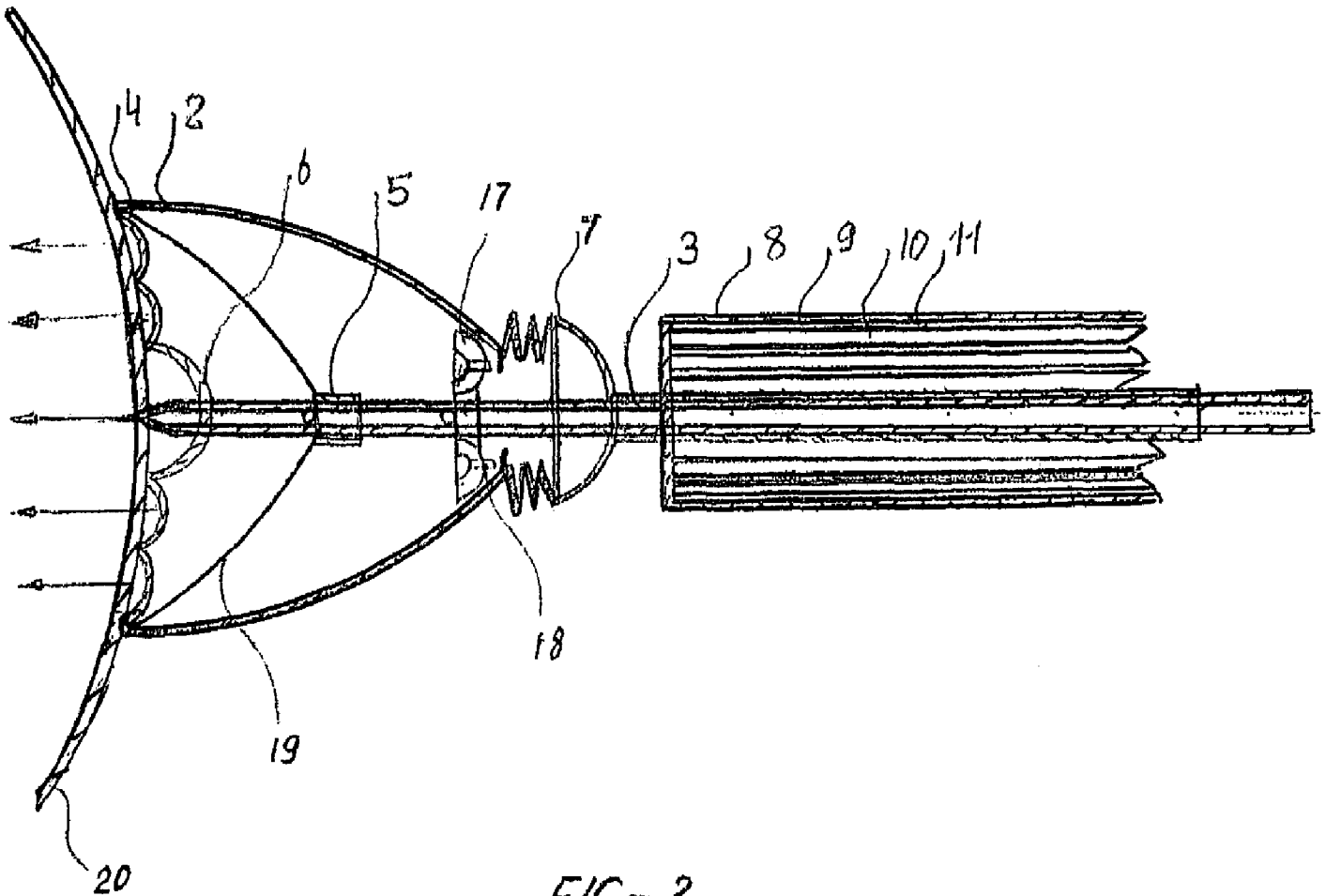
FIG. 2 illustrates a sectional side view of a substantial portion of the inventive device shown on FIG. 1, in the position of contact with a target, according to the preferred embodiment of the present invention.
Figure 3:
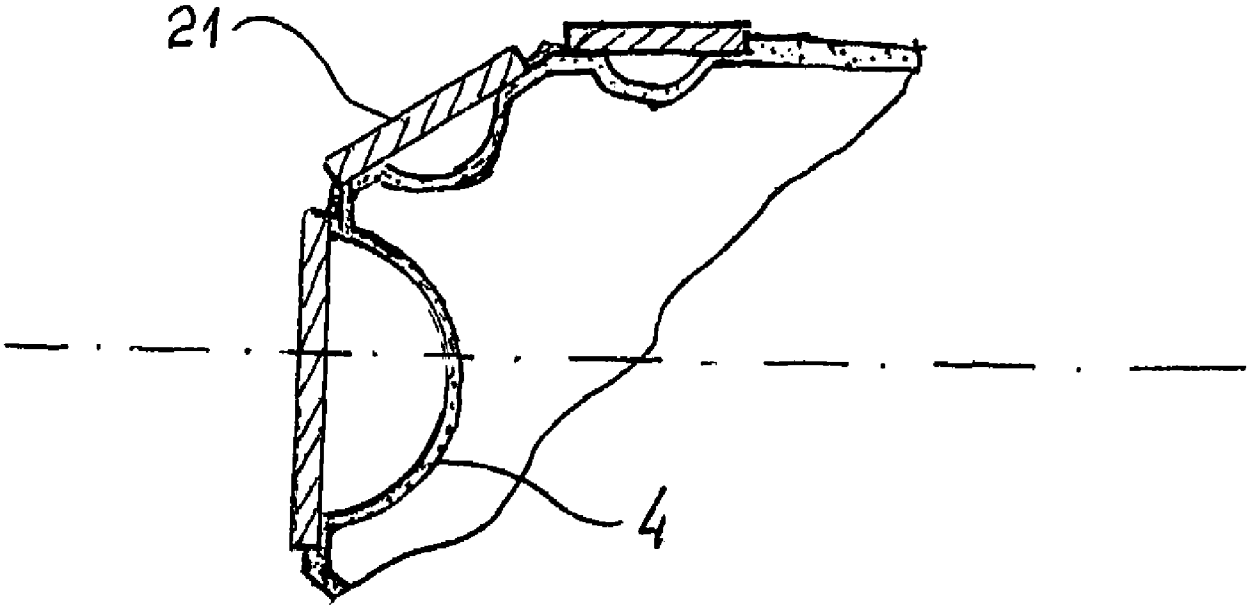
FIG. 3 illustrates a sectional side view of a portion of the inventive device shown on FIG. 1, depicting the magnetic rings, according to the preferred embodiment of the present invention.

A portion (20) of a solid target (commonly an enemy ship or submarine) is illustrated on FIG. 2. Usually, the target's surface is covered by armour, having magnetic properties.

Operation of the Preferred Embodiment of Present Invention

The inventive torpedo, shown on FIG. 1, initially installed on a launching platform (not shown), is pointed at a target, and a "launch" command is issued. The electrical fuses 14 ignite the detonators 16 that initiate an ignition the gunpowder load 10 inside the pipes 9, creating an explosive combustion and causing a traction force, which fires the torpedo from the launching platform towards the target. The control unit 12 is turned on and controls the movement of the torpedo. During the explosive combustion process of the load 10, the thin aluminum double walls of the pipes 9 are heated up, developing in the internal space 11*a* temperature of about 1000.degree.C. The water body in the space 11 is gasified and outlet from the opened rear end of space 11 of the pipes 9, increasing the traction force of the engine unit. In this way the explosive combustion energy of load 10 is more efficiently utilized, and increases the velocity of the inventive torpedo.

At the moment of encountering of the torpedo with the target (represented by its portion 20 of FIG. 2), the front portion of axle 3 hits the target 20, the axle 3 moves backward, the plastic casing 1 ruptures, and the latch mechanism of the bushing 5 is triggered, releasing the spokes 19, unbending them, and causing a predetermined increase of the angle between the spokes 19, unfolding the front portion of the rubber container 2 as depicted on FIG. 2. The central magnetic cup 6 is then moved forward due to inertial forces, and attracted to the armour of the target portion 20. The cumulative cavities 4, directed towards the target 20 with their openings, are also attracted by their magnetic rings 21 to the target portion 20 creating the condition of a cumulative explosion.

Due to inertial forces, the formatter 7 moves forward and displaces from the rear end of the axle 3 to the middle region of the axle 3, folding the rear portion of the rubber container 2, and causing the rear portion of the granulated TNT explosive charge therein to be displaced into the middle and front portions of container 2, which is reflected on FIG. 2. In fact, this transformation of the rubber container 2 converts the initially elongated TNT charge into a cumulative TNT charge. The movement of the formatter 7 continues until it meets the intermediate cups 17 and pushes the press-detonators 18 that detonates them. This causes a cumulative explosion of the TNT explosive charge in the rubber container 2, producing a powerful narrow shockwave essentially directed toward the surface 20, and thereby effectively defeating the target.

When the full displacement of the TNT explosive charge to the front position of the rubber container 2 takes place, the explosive charge's configuration of the torpedo changes so that it converts into an explosive charge's configuration of a cumulative magnetic mine of a direct action. This allows advantageously using the device as a torpedo for high speed of movement to the target, and, on the other hand, using the device as a cumulative mine for increased explosive capacity.

RAMIFICATIONS OF THE PRESENT INVENTION

Other embodiments may adapt different reshaping means (e.g. pneumatic, hydraulic, or based on other mechanisms) in place of the axle 3, bushing 5, spokes 19, and formatter 7, while deploying the inertial forces developed upon encountering a solid target, and changing the shape of a resilient container means (similar to the rubber container 2), having frontal cumulative magnetic cavities (similar to the cumulative cavities 4) and a central magnetic cup (similar to the cup 6). Some embodiments (e.g. those that do not comprise the axle 3) may have no central magnetic cup 6.

Other embodiments may use not inertial forces, but different means for initiating the changing of the resilient container means' shape, such changing may be performed upon a command received by or pre-programmed in a control unit (similar to the control unit 12).

The resilient container means is preferably encapsulated in a casing means (similar to the casing 1), breakable upon encountering a solid target. The aforesaid change (reshaping) of the resilient container means' shape should transform an explosive charge (being in a granulated, friable, plastic, or even fluid state, and placed inside the resilient container means) of the elongated type into an explosive charge of the cumulative type.

I claim:

1. A torpedo device comprising:

a resilient container means including a front portion, having a predetermined number of cumulative cavities thereon facing outside the container means, the cumulative cavities each furnished with a magnetic ring disposed at the periphery of the cavity, said resilient container means filled with an explosive charge of an elongated type;

reshaping means capable to change the shape of the resilient container means, so that converting the explosive charge of the elongated type into an explosive charge of a cumulative type; and detonation means capable to initiate a cumulative explosion of said explosive charge of the cumulative type.

2. The torpedo device according to claim 1, wherein the explosive charge of the elongated type comprising granulated trotyl.

3. The torpedo device according to claim 1, further comprising a casing means encapsulating said resilient container means, the casing means breakable upon encountering a solid target, the casing means having a rear portion; and wherein said resilient container means including a rear portion and a middle portion;

said reshaping means comprising:

a bearing tubular axle extending inside said resilient container means along the longitudinal axis of the device, said axle including a front end, a middle region, and a rear end;

a central bushing slidely disposed on the axle;

a plurality of springed spokes disposed in said resilient container means and associated with said bushing, the spokes so configured that capable to bend and unbend depending on the position of said bushing on said axle, thereby changing the shape of said front portion of the resilient container means; and a rear formatter, joined with the rear portion of said resilient container means, said formatter preferably shaped as a cup having an opening facing said resilient container means, the formatter slidely disposed on the axle so that capable to displace said explosive charge from the rear portion to the middle and front portions of said resilient container means upon said axle encountering a solid target, and capable to initiate an ignition of said detonation means.

4. The torpedo device according to claim 3, further comprising a magnetic cumulative cup attached to the front portion of the resilient container means with its opening facing outside the resilient container means, and the magnetic cup slidely disposed at the front end of the axle.

5. The torpedo device according to claim 3, further comprising an engine unit including a shell, having a front part fixedly connected to the rear portion of the casing; the shell containing a number of thin double-wall pipes disposed parallel to the longitudinal axis of device, each said pipe having a rear end; wherein an inner space inside each said pipe filled with fuel, an internal space located between the double walls of each said pipe filled with water, the internal space initially closed and capable to open after a launch of the torpedo device.

6. The torpedo device according to claim 5, wherein said fuel comprising a load of compressed artillery pyroxylin gunpowder;

each said pipe furnished with a primary gunpowder ignition detonator having an electrical fuse, and the ignition detonator mounted at the rear end of the pipe.

* * * * *